US009198483B2

(12) United States Patent
Adams et al.

(10) Patent No.: US 9,198,483 B2
(45) Date of Patent: Dec. 1, 2015

(54) SELF ADHERING CONNECTION SURFACES, STRAPS, SNAPS AND BANDS

(71) Applicants: Thomas M. Adams, San Antonio, TX (US); James D. Benner, Jr., San Antonio, TX (US)

(72) Inventors: Thomas M. Adams, San Antonio, TX (US); James D. Benner, Jr., San Antonio, TX (US)

( * ) Notice: Subject to any disclaimer, the term of this patent is extended or adjusted under 35 U.S.C. 154(b) by 0 days.

(21) Appl. No.: 14/217,057

(22) Filed: Mar. 17, 2014

(65) Prior Publication Data

US 2014/0283342 A1 Sep. 25, 2014

Related U.S. Application Data

(60) Provisional application No. 61/800,427, filed on Mar. 15, 2013, provisional application No. 61/867,548, filed on Aug. 19, 2013.

(51) Int. Cl.
*A44B 18/00* (2006.01)

(52) U.S. Cl.
CPC ..... *A44B 18/0019* (2013.01); *A44B 18/0007* (2013.01); *Y10T 24/27* (2015.01)

(58) Field of Classification Search
CPC ..... A44B 18/0053; A44B 18/0065; A44B 18/0007; A44B 18/0019; B29C 33/005; B29C 45/44; Y10S 24/39; Y10S 24/40; Y10S 24/50; Y10T 24/27
USPC ..... 24/306, 442, 450, 452
See application file for complete search history.

(56) References Cited

U.S. PATENT DOCUMENTS

| | | | | |
|---|---|---|---|---|
| 3,192,589 | A * | 7/1965 | Pearson | 24/452 |
| 3,930,287 | A | 1/1976 | Grise et al. | |
| 4,183,120 | A | 1/1980 | Thorne | |
| 5,067,210 | A * | 11/1991 | Keyaki | 24/452 |
| 5,119,531 | A * | 6/1992 | Berger et al. | 24/586.1 |
| 5,179,767 | A * | 1/1993 | Allan | 24/442 |
| 5,212,853 | A * | 5/1993 | Kaneko | 24/452 |
| 5,235,731 | A * | 8/1993 | Anzai et al. | 24/590.1 |
| 5,379,491 | A | 1/1995 | Solo | |
| 5,537,720 | A * | 7/1996 | Takizawa et al. | 24/452 |
| 5,797,170 | A * | 8/1998 | Akeno | 24/452 |
| 6,061,881 | A * | 5/2000 | Takizawa et al. | 24/446 |
| 6,314,622 | B1 | 11/2001 | Takizawa et al. | |
| 6,460,230 | B2 | 10/2002 | Shimamura et al. | |
| 6,763,556 | B2 | 7/2004 | Fagan et al. | |
| 6,983,517 | B2 | 1/2006 | Golden et al. | |
| 7,678,318 | B2 | 3/2010 | Line et al. | |
| D616,181 | S | 5/2010 | Harada et al. | |
| 2002/0069495 | A1 * | 6/2002 | Murasaki | 24/442 |

(Continued)

*Primary Examiner* — Robert J Sandy
*Assistant Examiner* — David Upchurch
(74) *Attorney, Agent, or Firm* — Kammer Browning PLLC

(57) ABSTRACT

A system of attachment surface structures that find their best use in the form of repeatedly removable straps and bands for securing one object to another. The surfaces are preferably constructed of narrow sheets of flexible polymer plastic materials having generally high tensile strength. A first embodiment includes shaped parallel ridges on one surface that interlock with mating parallel ridges on an opposing surface. These parallel ridges may be double sided (interlocking on both sides of each shaped ridge with the next shaped ridge on either side) or single sided (interlocking with a single ridge oriented 180 degrees from the first). Further embodiments include an array of shaped posts of various regular geometric shapes that interlock with an opposing array of identical posts. Further embodiments include parallel ridge pairs that interlock with parallel post-type ridges that lend themselves to extrusion manufacturing.

9 Claims, 15 Drawing Sheets

(56) References Cited

U.S. PATENT DOCUMENTS

2008/0134480 A1 6/2008 Shiue
2010/0146743 A1 6/2010 Rome
2012/0297581 A1 11/2012 Pitman et al.

* cited by examiner (A-A′)

(B-B′)

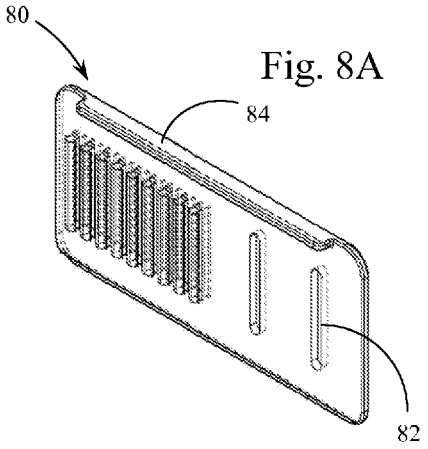
Fig. 8A
Fig. 8B
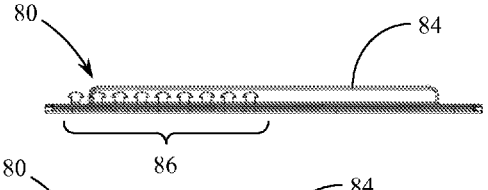
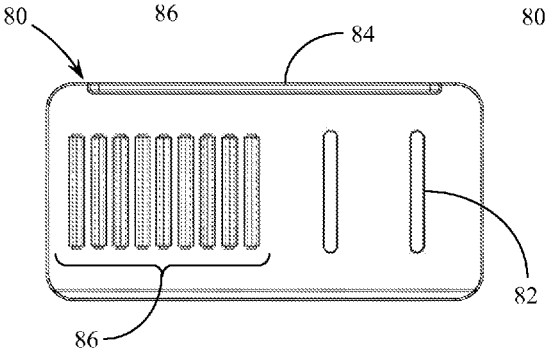
Fig. 8C
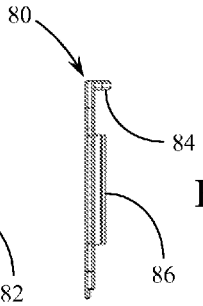
Fig. 8D (C-C′)

(Detail A)

(D-D′)

(Detail B)

SELF ADHERING CONNECTION SURFACES, STRAPS, SNAPS AND BANDS

CROSS REFERENCES TO RELATED APPLICATIONS

This application claims the benefit under Title 35 United States Code §119(e) of U.S. Provisional Patent Application Ser. No. 61/800,427, filed: Mar. 15, 2013; and U.S. Provisional Patent Application Ser. No. 61/867,548, filed: Aug. 19, 2013, the full disclosures of which are each incorporated herein by reference.

BACKGROUND OF THE INVENTION

1. Field of the Invention

The present invention relates generally to attachment surfaces, straps and bands. The present invention relates more specifically to an attachment surface structured to allow identical sections of the surface to removably attach together.

2. Description of the Related Art

Efforts have been made in the past to provide surfaces (most often in the form of straps or bands) that removably and repeatedly adhere to each other for the purpose of securing one object to another. One example of such types of surfaces is a hook surface operable in conjunction with a loop surface, developed and marked under the brand name Velcro®. Hook and loop surfaces suffer from a number of drawbacks. Both surfaces tend to collect fibrous dust, strings, and other material that fowls the surfaces and degrades their ability to adhere to one another. A further disadvantage of hook and loop surfaces is the requirement to manufacture and sell two different types of surfaces rather than a single type of surface that can adhere to another section of the same type of surface.

It would be desirable to have attachment surfaces that overcame the problems associated with the more common hook and loop combination surfaces. It would be desirable if a single type of surface could be manufactured and two sections of the single type of surface would adhere to each other. It would be desirable if the surfaces were not prone to become fowled with fibers, dust, threads, and other materials that might degrade their function.

SUMMARY OF THE INVENTION

In fulfillment of the above objectives the present invention provides a number of attachment surface structures that find their best use in the form of repeatedly removable straps and bands for securing one object to another. The surfaces are preferably constructed of narrow sheets of flexible polymer plastic materials having generally high tensile strength (bendable but not stretchable). A first set of embodiment includes shaped parallel ridges on one face of strap or band that interlock with mating parallel ridges on an opposing strap or band. These parallel ridges may be double sided (interlocking on both sides of each shaped ridge with the next shaped ridge on either side) or single sided (interlocking with a single ridge oriented 180 degrees from the first). A second set of embodiments includes an array of "umbrella" shaped posts that interlock with an opposing array of identical posts on a second section of strap. The second set of embodiments may be constructed using a variety of regular geometric shapes (square, triangle, pentagon, and hexagon, for example) that permit adherence between the surfaces in other than laterally aligned orientations.

BRIEF DESCRIPTION OF THE DRAWINGS

FIG. 8A is an isometric view of a further embodiment of the present invention showing a connector bottom with attachment slots and alignment bar.

FIGS. 8B-8D are three orthographic views of the connector bottom shown in FIG. 8A.

DETAILED DESCRIPTION OF THE PREFERRED EMBODIMENTS

Figure 1:
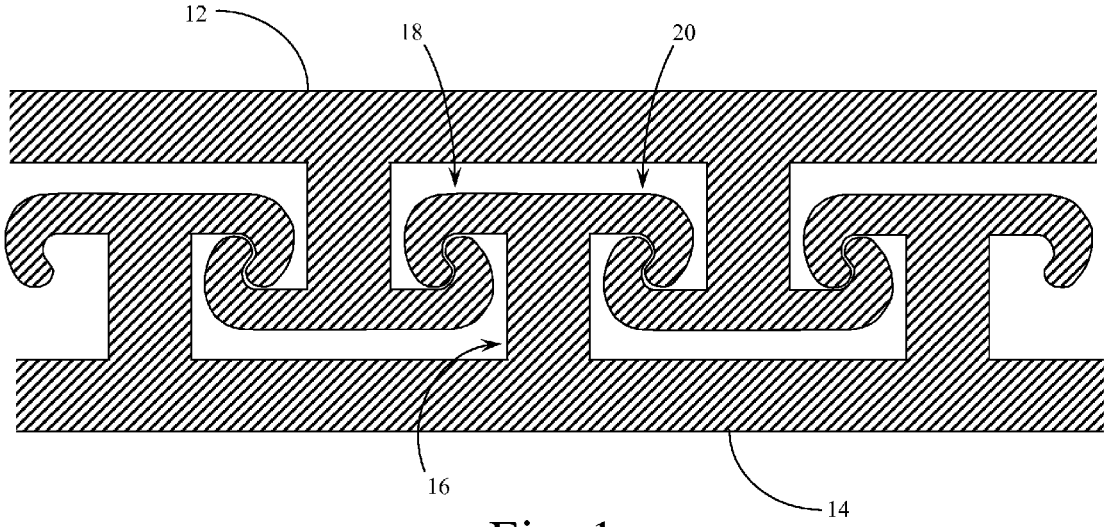
FIG. 1 is a detailed cross-sectional view of a double sided embodiment of the attachment surfaces system of the present invention, viewed along Section Line A-A' in FIG. 5.

Reference is made first to FIG. 1 which is a detailed cross-sectional view of a double sided embodiment of the attachment surfaces system of the present invention. The cross section shown in FIG. 1 represents the structure of both a double sided ridge based embodiment and a double (or multiple) sided post embodiment. The structure could, for example reflect a cross section of the embodiment shown in FIG. 5 (square post array) as viewed along Section Line A-A' therein, as well as a double sided parallel ridge embodiment. In either case the flexible material from which the generally flat straps or bands 12 & 14 are constructed to allow the ridges (or posts) 16 from one surface to press into and interlock with the same ridges (or posts) present on an opposing strap or band. This interlock is achieved between what are essentially the same structures positioned in opposition to each other. In FIG. 1 these structures represent arms 18 & 20 extending off of ridge (or post) 16 that interlock with corresponding arms positioned on the opposing strip. This interlock maintains adherence between the surfaces, especially in the face of longitudinal force. The surfaces may separate relatively easily with a transverse rolling force (see FIG. 4) when the user wants to separate the surfaces.

Figure 2:
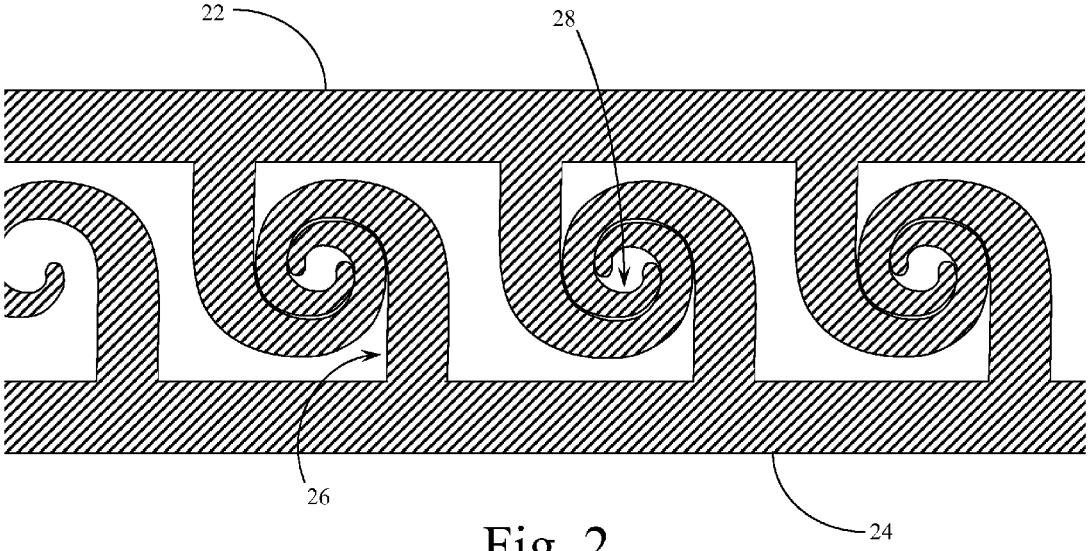
FIG. 2 is a detailed cross-sectional view of a single sided embodiment of the attachment surfaces system of the present invention, viewed along Section Line B-B' in FIG. 4.

FIG. 2 is a detailed cross-sectional view of a single sided embodiment of the attachment surfaces system of the present invention, essentially eliminating one interlocking side of each parallel ridge. In FIG. 2, flat straps or bands 22 & 24 are constructed to allow the ridges (or posts) 26 from one surface to press into and interlock with the same ridges (or posts) present on an opposing strap or band. In this embodiment, a single curled arm 28 extends from ridge (or post) 26 to interlock with a corresponding curled arm from the opposing strap or band. The embodiment shown in FIG. 2 retains the strength of adherence by increasing the degree to which the ridges interlock. While this maintains the hold between the surfaces in one direction it does reduce the hold in the opposing direction. This characteristic may be beneficial where the desire is to secure a strap or band pulled in one direction from being released in the opposite direction. This would be helpful where, for example, a strap is used to tighten or close one component over and against another, such as in a shoe or a tie down, where an opposing force is oriented in the direction that the surface to surface adherence is strongest.

Figure 3:
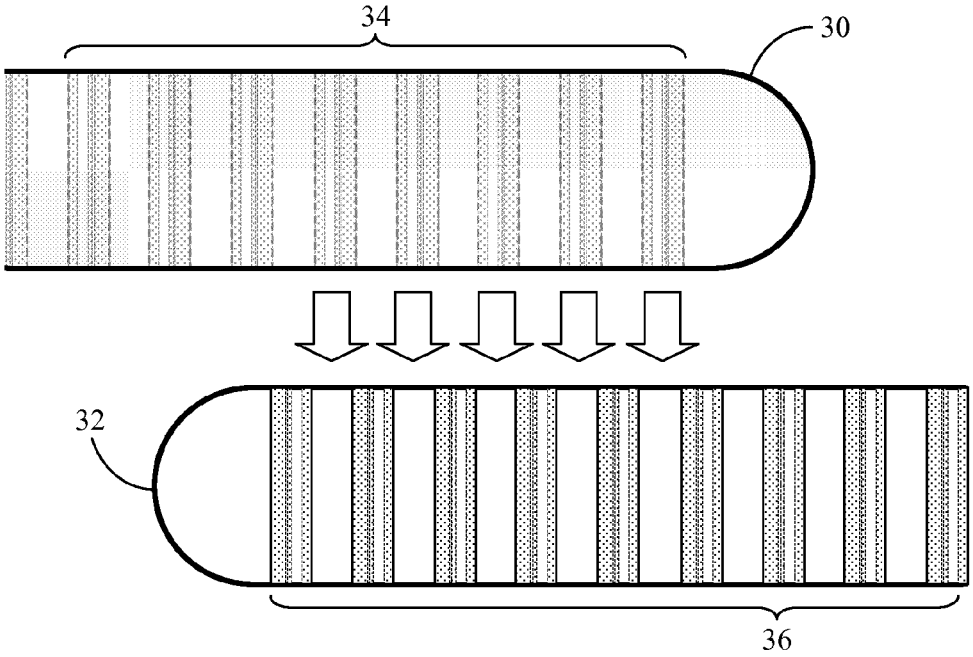
FIG. 3 is a top plan view of two opposing straps implementing the parallel ridge embodiment of the attachment surfaces system of the present invention, the straps shown separated before attachment.
Figure 4:
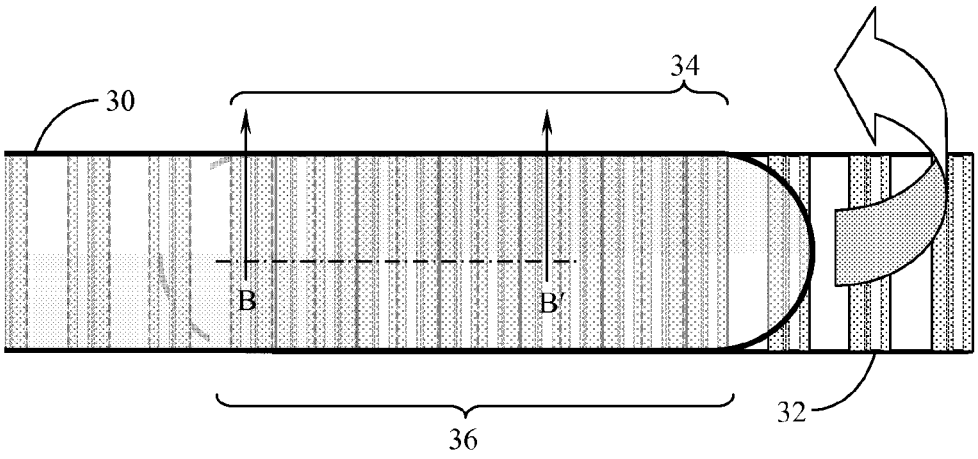
FIG. 4 is a top plan view of two opposing straps implementing the parallel ridge embodiment of the attachment surfaces system of the present invention, the straps shown overlaid and attached one to the other.

The cross section view of FIG. 2 best represents the parallel ridge structure shown in FIGS. 3 & 4, as viewed along Section Line B-B' in FIG. 4. Again, orientation of the straps 22 & 24 is such that the force that tends to longitudinally pull the straps apart is most strongly resisted by the interlocking structure. The flexibility of the interlocking "arms" 28 (seen in cross section) on each ridge 26 allows for the structures to coil together as shown in FIG. 2. Pulling the straps 22 & 24 apart (in a direction orthogonal to the surfaces) allows these interlocking structures to uncoil and release. Once again, one of the most important features of the present invention is the identical structure of the two opposing surfaces 22 & 24.

FIG. 3 is a top plan view of two opposing straps 30 & 32 implementing the parallel ridge 34 embodiment of the attachment surfaces system of the present invention, the straps 30 & 32 shown separated before attachment. The lower strap 32 (oriented with the rounded end to the left) shows the parallel ridges 36 on its upper face. The upper strap 30 (oriented with the rounded end to the right) shows the hidden parallel ridges 34 in broken line form for purposes of viewing how the ridges 34 & 36 align and interlock. Reference is again made to FIG. 2 for the best representation of this interlocking action. The arrows in FIG. 3 show the manner in which the straps 30 & 32 may be pressed together to achieve the interlocking action.

FIG. 4 is a top plan view of the two opposing straps 30 & 32 implementing the parallel ridge embodiment shown in FIG. 3; the straps 30 & 32 shown overlaid and attached one to the other. The curved arrow in FIG. 4 shows the manner in which the top strap 30 may be pulled up and back so as to release the interlocking structures and separate the straps. Adjustment of the longitudinal tightness of the straps may be made by pulling one strap further along the other, incrementally moving to the next ridges on the second strap for each of the parallel opposing ridges on the first strap. In this manner, the strength of the longitudinal force (the tightness) may be incrementally increased or decreased.

Figure 5:
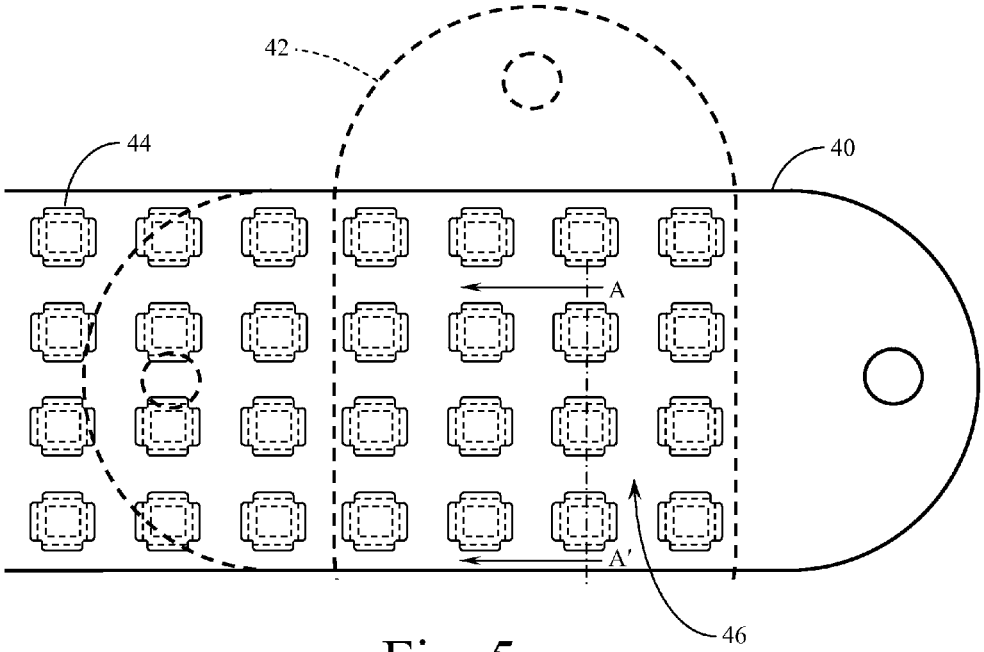
FIG. 5 is a top plan view of one strap implementing the post array (square) embodiment of the attachment surfaces system of the present invention, a second opposing strap shown in broken line form to show the multiple orientations possible with the embodiment.
Figure 6:
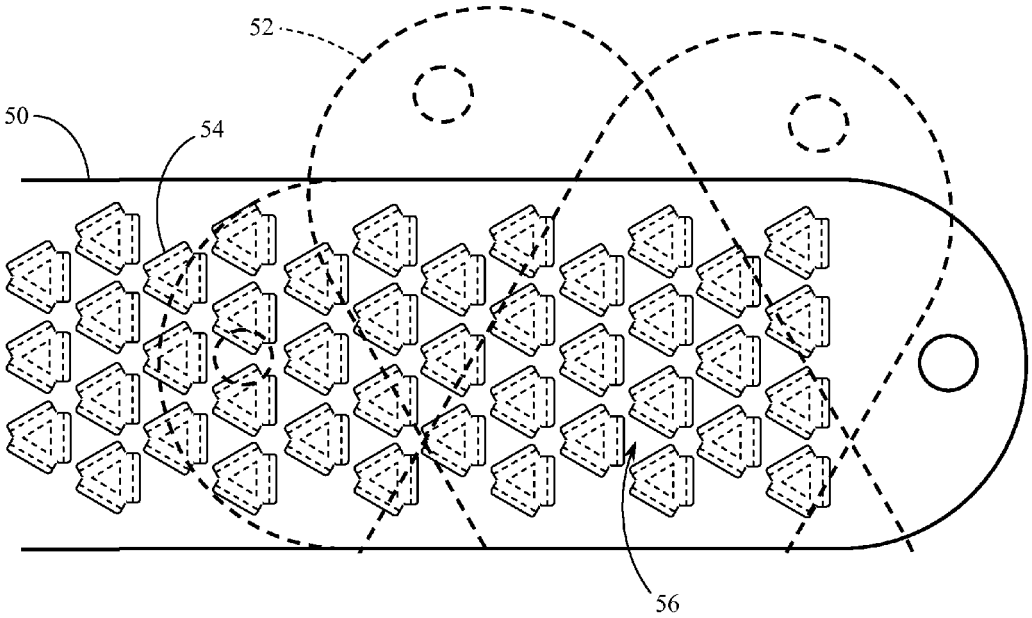
FIG. 6 is a top plan view of one strap implementing the post array (triangular) embodiment of the attachment surfaces system of the present invention, a second opposing strap shown in broken line form to show the multiple orientations possible with the embodiment.

Reference is next made to FIGS. 5 & 6 for a description of an alternate post array embodiment of the present invention. Whereas the parallel ridge embodiment lends itself to strength of attachment when one strap is oriented parallel to the other (directly overlaying), the post array embodiment allows for non-aligned orientation of the straps.

FIG. 5 is a top plan view of one strap 40 implementing the post array 44 (square) embodiment of the attachment surfaces system of the present invention, a second opposing strap 42 shown in broken line form to show the multiple orientations possible with the embodiment. With each "umbrella" shaped post 44 (seen from the top in this view) having four interlocking structures (oriented outward 90 degrees to each other) a similar surface may interlock into an opposing space 46 in either a longitudinal or a transverse orientation (as shown in broken line form). Although a strap implementation of this embodiment is shown in FIG. 5, the post array embodiment lends itself to implementation with larger patches of attachment surfaces that may serve to secure more than one strap, possibly oriented in two directions.

FIG. 6 is a top plan view of one strap 50 implementing the post array 54 (triangular) embodiment of the attachment surfaces system of the present invention, a second opposing strap 52 shown in broken line form to show the multiple orientations possible with this embodiment. With a triangular post structure 54 the attachment orientation may be in 60 degree rotations as shown with respect to an opposing space 56. Here again, although a strap implementation of this embodiment is shown in FIG. 6, the post array embodiment lends itself to implementation with larger patches of attachment surfaces that may serve to secure more than one strap, possibly oriented in two or more different directions. A single larger circular patch of material could, for example, receive and secure three separate straps coming together from three different directions (generally at 60 degrees of rotation from each other).

Implementation of the post array embodiment of the present invention may be made also with other regular geometric structures, most notably with hexagonal post configurations. Increasing the number of sides does however decrease the length of each interlocking grip thereby diminishing somewhat the strength of the hold. Nonetheless there are likely applications where increased options with regard to orientation are preferred over the strength of the hold.

Figure 7A:
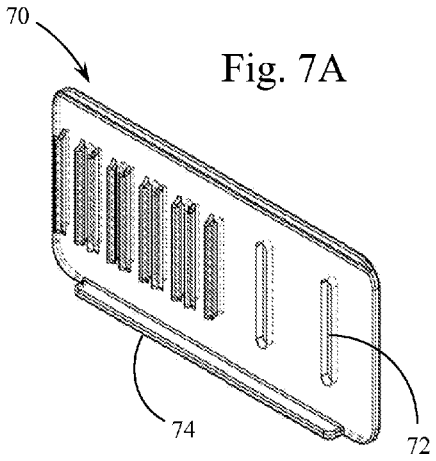
FIG. 7A is an isometric view of a further embodiment of the present invention showing a connector top with attachment slots and alignment bar.
Figure 7B:
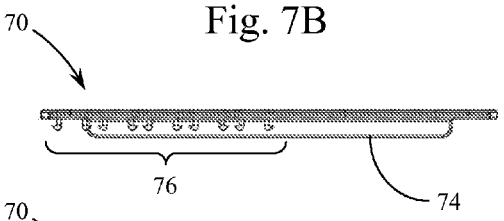
FIGS. 7B-7D are three orthographic views of the connector top shown in FIG. 7A.
Figure 7C:
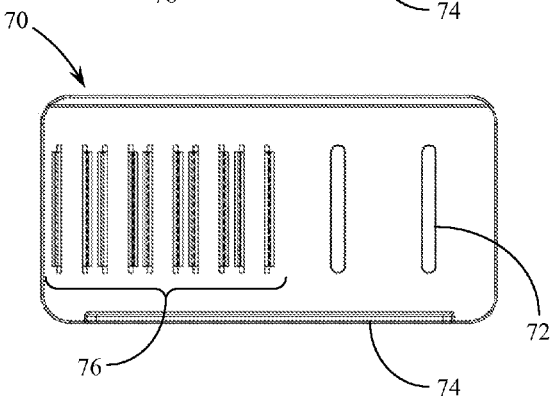
Figure 7D:
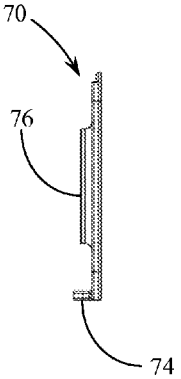

FIGS. 7A-7D are an isometric view and three orthographic views of a further embodiment of the present invention showing a connector top 70 with attachment slots 72 and alignment bar 74. FIGS. 8A-8D are an isometric view and three orthographic views of a corresponding connector bottom 80 mateable to the connector top 70 shown in FIGS. 7A-7D. In this embodiment, attachment slots 72 & 82 are shown in each component 70 & 80 for attaching the components to the materials to be connected (such as straps, panels, or the like). In this embodiment, parallel ridges 76 are positioned on connector top 70 and comprise paired ridges 76 with opposing, inwardly directed, pointed edges as shown in FIG. 7B. These paired ridges 76 interlock with ridges 86 on opposing connector bottom 80. Ridges 86 comprise single walled ridges with caps having opposing pointed edges that engage with the inwardly directed pointed edges of paired ridges 76. Additionally, alignment bars 74 & 84 are disclosed on components 70 & 80 to facilitate the aligned mating of the connector component ridges 76 & 86.

FIGS. 9A-9D are an isometric view and three orthographic views of a further embodiment of the present invention showing a connector top 90 designed to be sewn onto a substrate to be connected. FIGS. 10A-10D are an isometric view and three orthographic views of a corresponding connector bottom 100 mateable to the connector top 90 shown in FIGS. 9A-9D. In this embodiment, each component 90 & 100 is sewn onto the materials to be connected (such as straps, panels, or the like). Ridges 96 shown in FIG. 9B on connector top 90 are essentially the same as those shown in FIGS. 7A-7D. Likewise, ridges 106 shown on connector bottom 100 are essentially the same as those shown on connector bottom 80 in FIGS. 8A-8D.

FIGS. 11A-11D are an isometric view and three orthographic views of a further triangular snap connector embodiment showing strap 110 with the inner connector half 116. FIGS. 12A-12D are an isometric and three orthographic views of a corresponding strap 120 with outer connector half 126 mateable to the inner connector half 116 shown in FIGS. 11A-11D. With the triangular version shown, the inner and outer halves 116 & 126 may be aligned at 0°, 60°, or 300° (−60°) with respect to each other and still form a secure attachment. This triangular structure may be extended to six sided or eight sided connector structures that will mate at several regular angles.

Figure 9A:
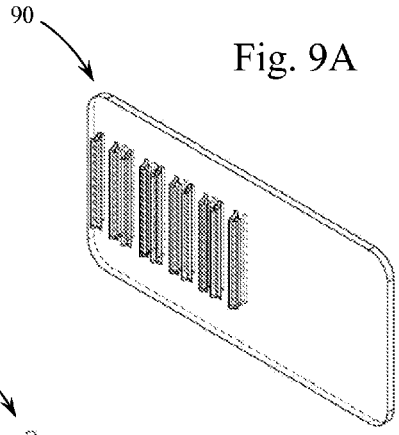
FIG. 9A is an isometric view of a further sew-on embodiment of the present invention showing a connector top.
Figure 9B:
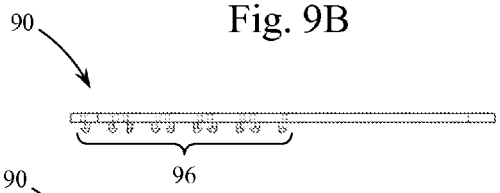
FIGS. 9B-9D are three orthographic views of the connector top shown in FIG. 9A.
Figure 9C:
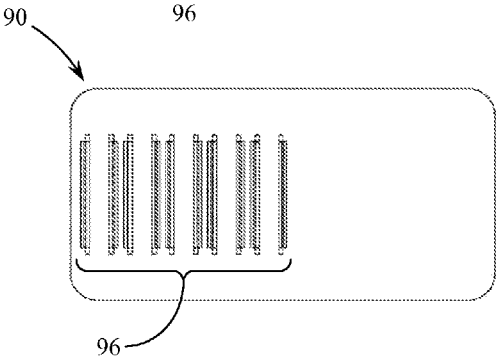
Figure 9D:
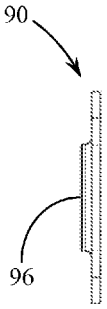
Figure 10A:
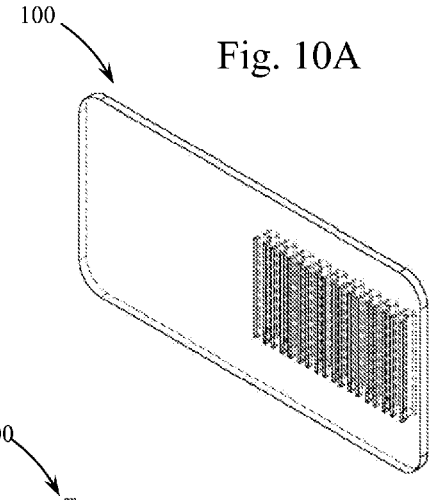
FIG. 10A is an isometric view of a further sew-on embodiment of the present invention showing a connector bottom.
Figure 10B:
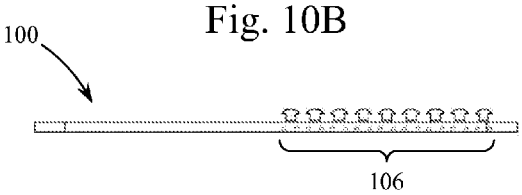
FIGS. 10B-10D are three orthographic views of the connector bottom shown in FIG. 10A.
Figure 10C:
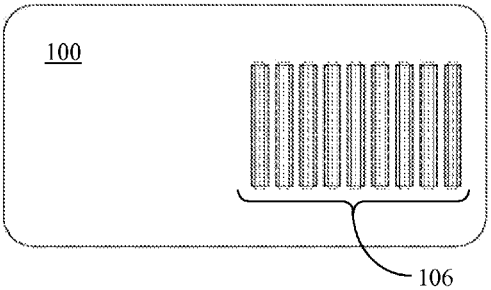
Figure 10D:
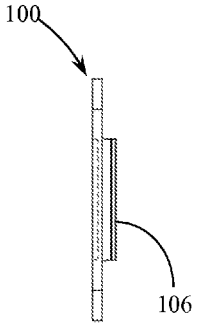
Figure 11A:
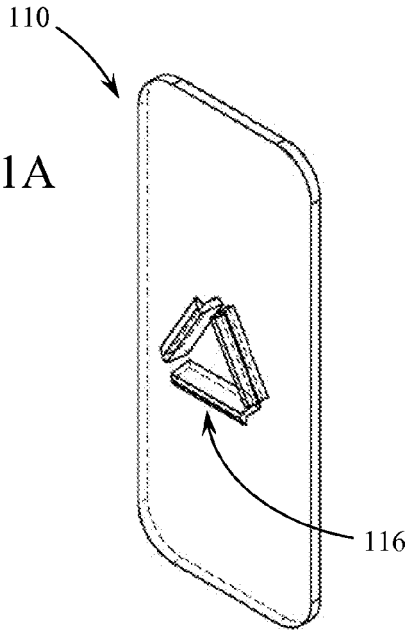
FIG. 11A is an isometric view of a further triangular snap connector embodiment of the present invention showing the inner connector half.
Figure 11B:
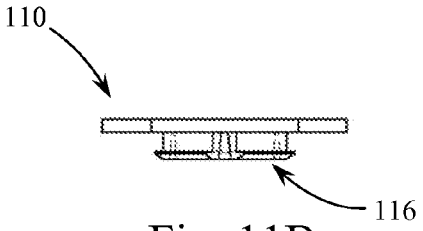
FIGS. 11B-11D are three orthographic views of the triangular snap connector inner connector half shown in FIG. 11A.
Figure 11C:
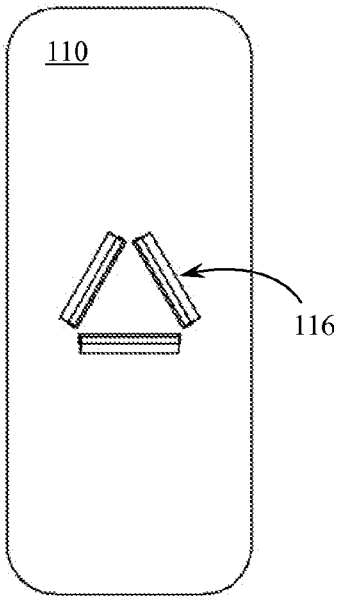
Figure 11D:
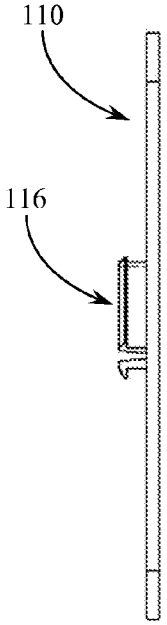
Figure 12A:
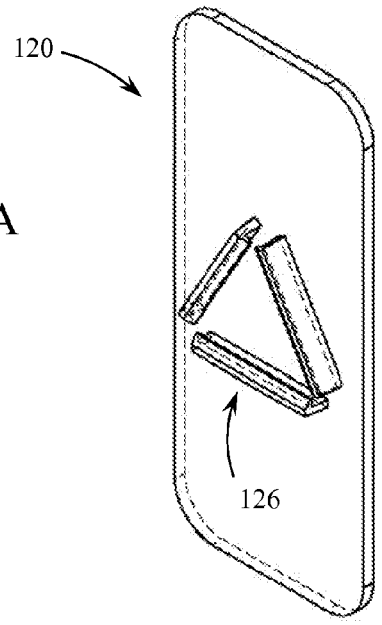
FIG. 12A is an isometric view of a further triangular snap connector embodiment of the present invention showing the outer connector half.
Figure 12B:
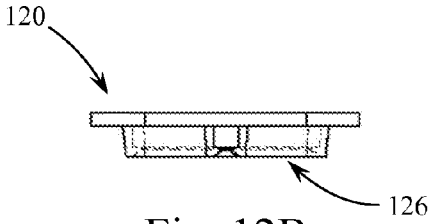
FIGS. 12B-12D are three orthographic views of the triangular snap connector outer connector half shown in FIG. 12A.
Figure 12C:
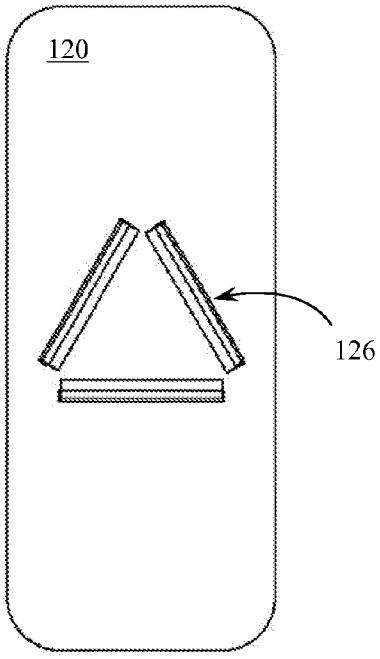
Figure 12D:
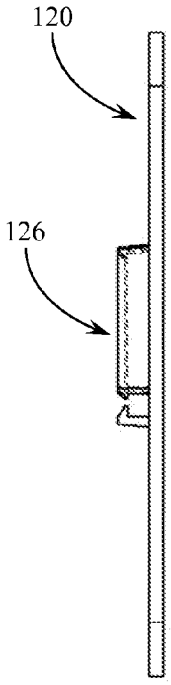
Figure 13:
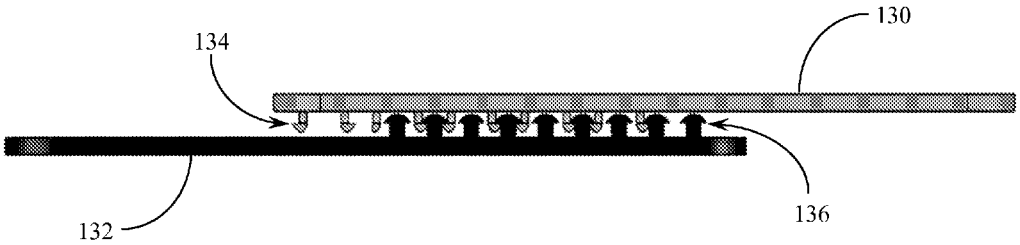
FIG. 13 is a cross sectional side edge view showing the manner of attachment between the top and bottom components shown in FIGS. 9A & 10A (for example).

FIG. 13 is a side edge view showing the manner of attachment between the top 130 and bottom 132 components shown in FIGS. 9A & 10A (for example). A similar manner of attachment is applicable to the top and bottom components shown in FIGS. 7A & 8A, although the additional attachment slots and alignment bars therein would be visible. Ridges 134 in top component 130 provide the opposing pair ridges with inwardly directed pointed edges that surround and engage with post ridges 136 on bottom component 132 that include outwardly directed pointed edges.

Figure 14A:
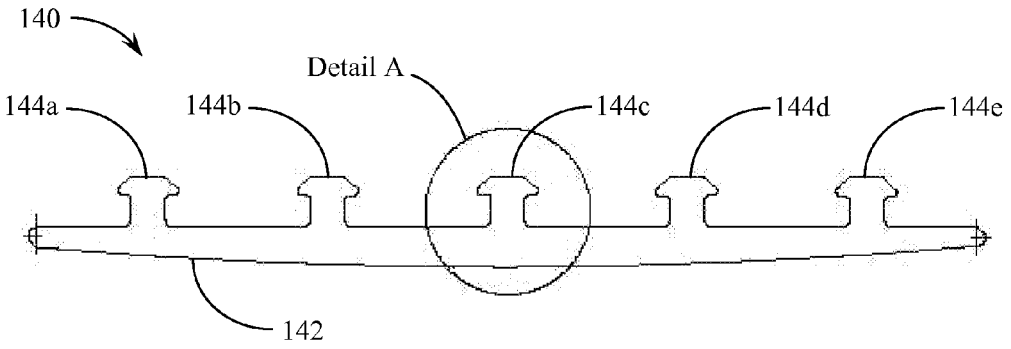
FIG. 14A is a cross-sectional view of a further embodiment of the present invention showing a connector bottom component capable of being manufactured using an extrusion process, viewed along Section Line C-C' in FIG. 14C.
Figure 14B:
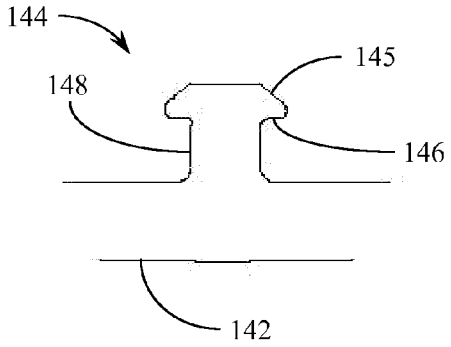
FIG. 14B is a detailed cross-sectional view of the connector bottom component shown in FIG. 14A (Detail A) disclosing the individual connector ridge structure.

Reference is next made to FIGS. 14A-14C, FIGS. 15A-15C, FIGS. 16A-16C, and FIGS. 17A-17C for a description of a further alternate embodiment of the present invention capable of being manufactured using an extrusion process. FIG. 14A is a cross-sectional view of an extrusion of plastic material configured with five rows of post-type ridges, viewed along Section Line C-C' in FIG. 14C. Connector bottom component 140 comprises a flat substrate 142, preferably on the order of one inch in width, although larger and smaller sizes are envisioned and possible, that supports (in this example) five post-type ridges 144*a*-144*e*. A detailed view (Detail A from FIG. 14A) of one of these post-type ridges 144 is shown in FIG. 14B. Positioned on substrate 142 is post section 148 (essentially a raised ridge that appears as a post in this cross-sectional view) that includes cap 145 having a pair of outwardly directed pointed edges 146. Edges 146 comprise rounded pointed edges to facilitate the latching and unlatching of the ridge from the opposing component described below.

Figure 14C:
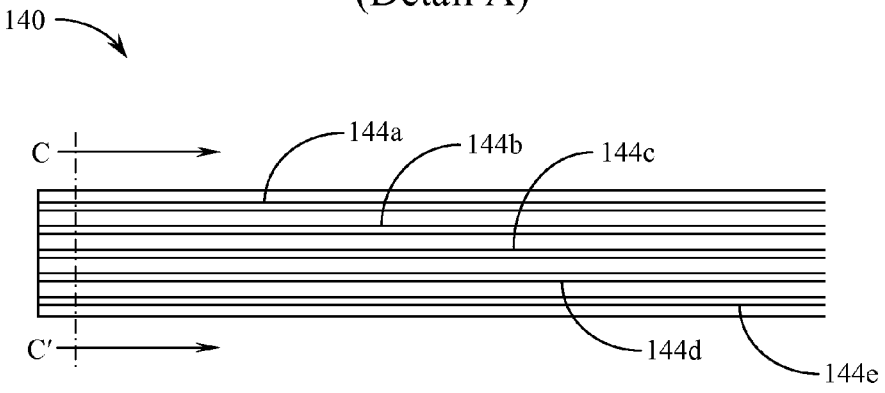
FIG. 14C is a top plan view of a section of the extrusion manufactured according to the structures of the connector bottom component shown in FIG. 14A.

FIG. 14C is a top plan view of a section of extruded bottom component 140 showing each of the five (in this example) ridges 144*a*-144*e*. Those skilled in the art will recognize how the described structure lends itself to manufacture by extrusion techniques.

Figure 15A:
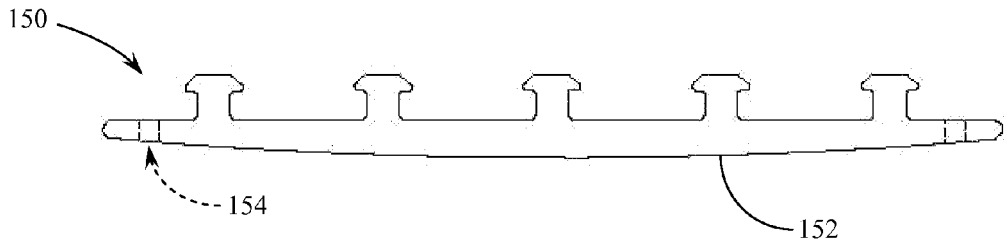
FIG. 15A is an end view of a portion of the connector bottom component of the embodiment of the present invention shown in FIG. 14A, cut from an extrusion, with holes positioned for attachment to a surface.
Figure 15B:
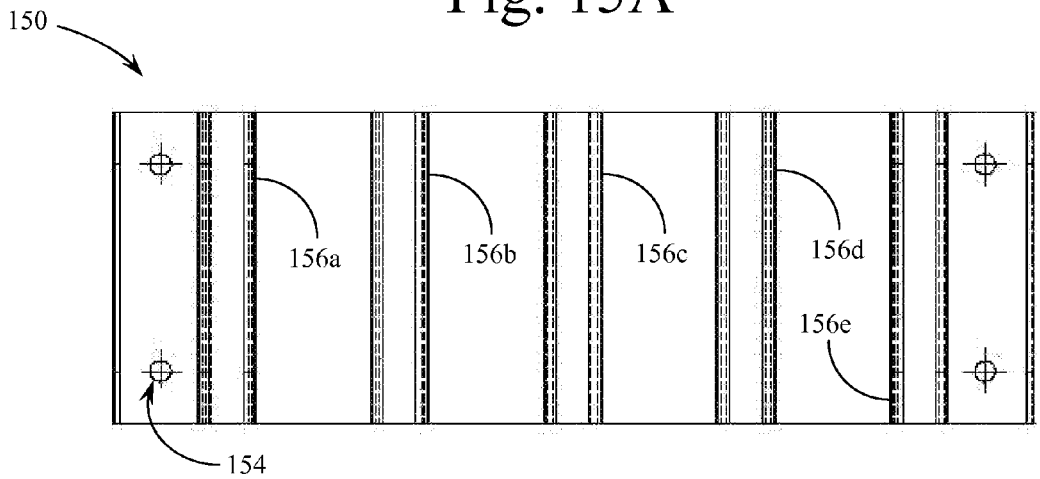
FIG. 15B is a top plan view of the portion of the connector bottom component shown in FIG. 15A.
Figure 15C:
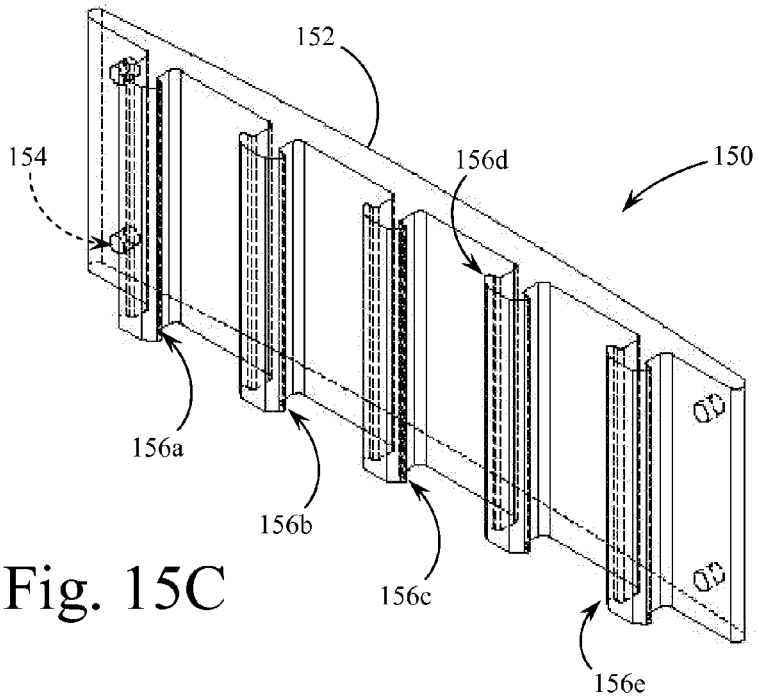
FIG. 15C is a perspective view of the portion of the connector bottom component shown in FIG. 15A.

FIGS. 15A-15C represent a section of the extrusion shown in FIGS. 14A-14C cut and modified to be used as a connector component. Bottom connector component 150 is shown to be structured on a section of substrate 152 with a number of attachment apertures 154 drilled or molded therein. Parallel post-type ridge sections 156*a*-156*e* are shown in a top plan view in FIG. 15B. FIG. 15C provides a perspective view showing both the arrangement of post-type ridge sections 156*a*-156*e* on substrate 152, as well as the placement of the plurality of apertures 154 drilled or molded into section of connector 150.

Figure 16A:
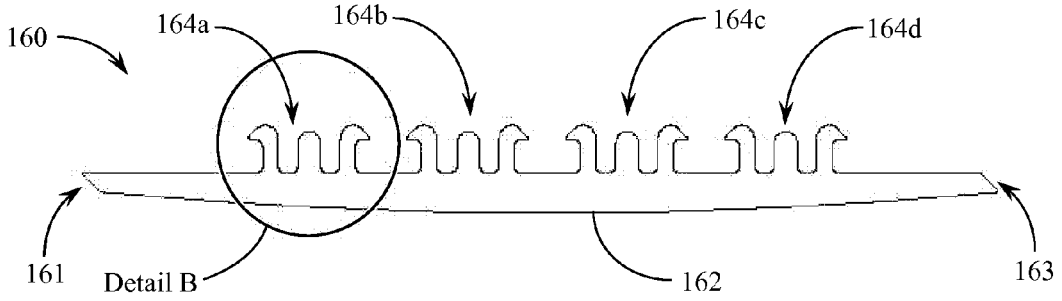
FIG. 16A is a cross-sectional view of the mateable section of the further embodiment of the present invention showing a connector top component capable of being manufactured using an extrusion process, viewed along Section Line D-D' in FIG. 16C.
Figure 16B:
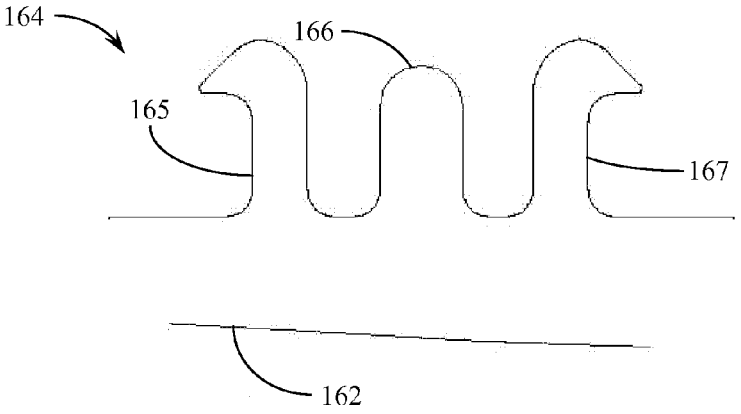
FIG. 16B is a detailed cross-sectional view of the connector top component shown in FIG. 16A (Detail B) disclosing the individual connector ridge structure.
Figure 16C:
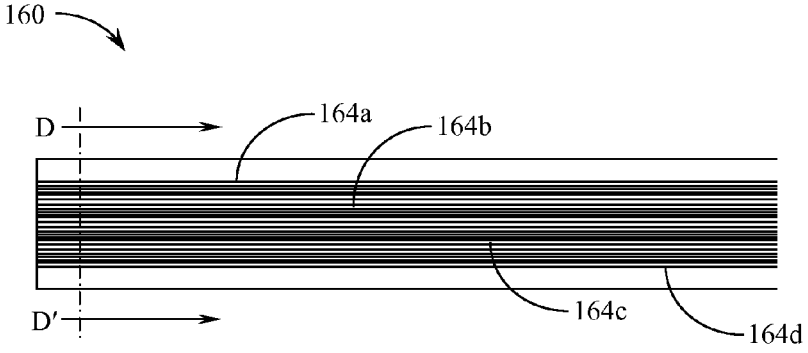
FIG. 16C is a top plan view of a section of the extrusion manufactured according to the structures of the connector top component shown in FIG. 16A.

FIG. 16A is a cross-sectional view of an extrusion of plastic material configured with four rows of paired opposing ridges, viewed along Section Line D-D' in FIG. 16C. Connector top component 160 comprises a flat substrate 162, preferably on the order of one inch in width, although larger and smaller sizes are envisioned and possible, that supports (in this example) four paired ridges 164*a*-164*d*. A detailed view (Detail B from FIG. 16A) of one of these pairs of opposing ridges 164 is shown in FIG. 16B. Positioned on substrate 162 are first and second opposing ridge walls 165 & 167. A blocking turret 166 is positioned between the first and second opposing ridge walls 165 & 167 to prevent that paired ridge row from impinging itself onto the ridge rails of the opposing part. In this manner the pointed edges of the respective ridges will always slide properly into the opposing part so that the pointed edges of the post ridge grasp the rail ridges of the opposing part. Angled edges 161 & 163 are provided to facilitate the fingertip attachment and release actions joining and separating the top and bottom components (see FIG. 18).

FIG. 16C is a top plan view of a section of extruded top component 160 showing each of the four (in this example) paired ridges 164*a*-164*d*. Those skilled in the art will recognize how the described structure lends itself to manufacture by extrusion techniques.

Figure 17A:
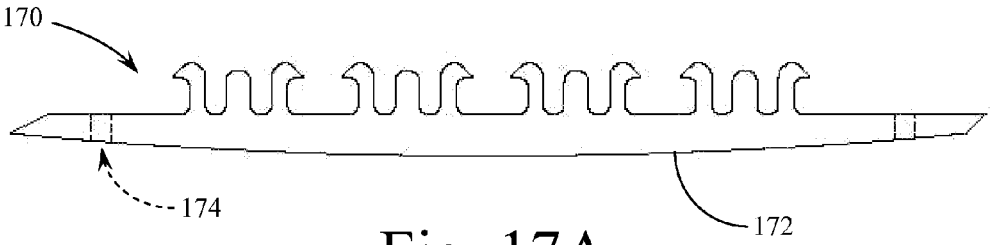
FIG. 17A is an end view of a portion of the connector top component of the embodiment of the present invention shown in FIG. 16A, cut from an extrusion, with holes positioned for attachment to a surface.
Figure 17B:
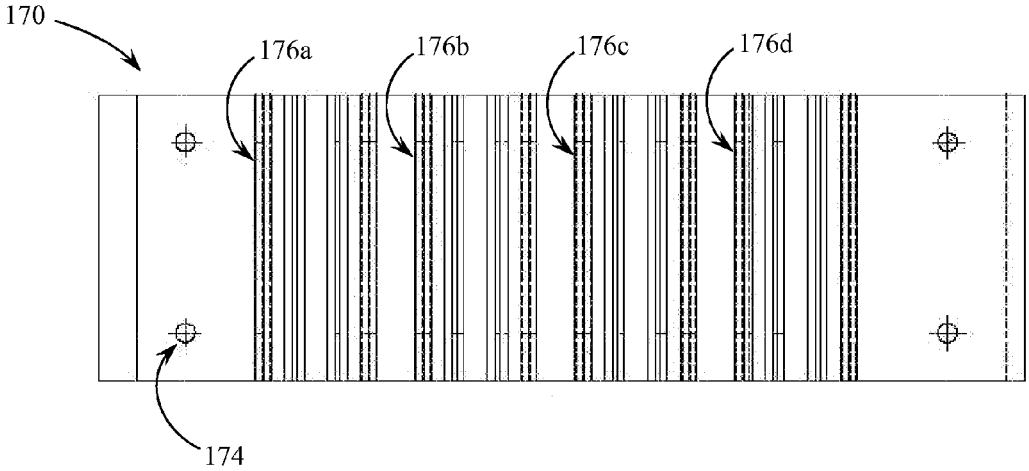
FIG. 17B is a top plan view of the portion of the connector top component shown in FIG. 17A.
Figure 17C:
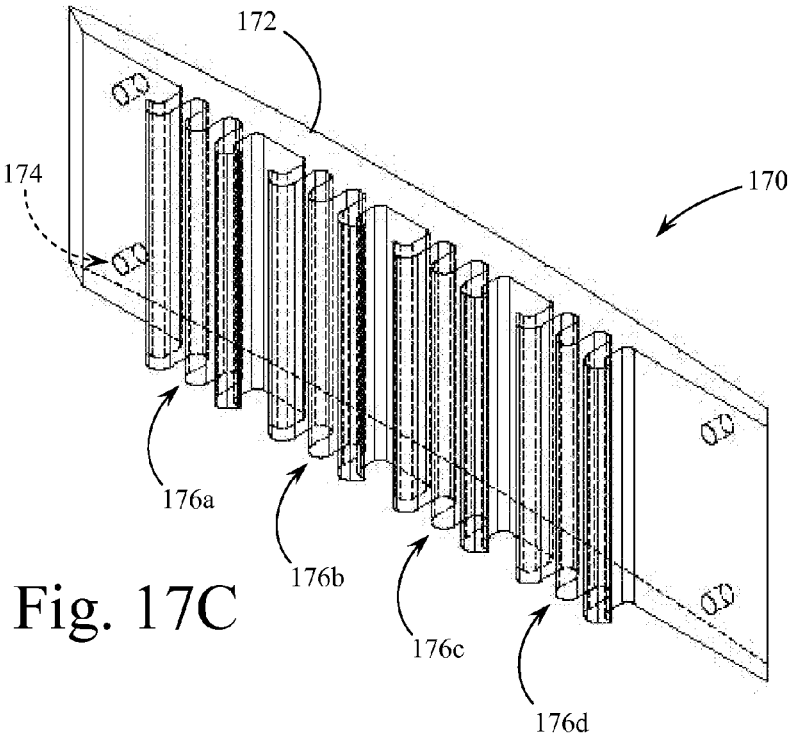
FIG. 17C is a perspective view of the portion of the connector top component shown in FIG. 17A.

FIGS. 17A-17C represent a section of the extrusion shown in FIGS. 16A-16C cut and modified to be used as a connector component. Top connector component 170 is shown to be structured on a section of substrate 172 with a number of attachment apertures 174 drilled or molded therein. Parallel opposing pair ridge sections 176*a*-176*d* are shown in a top plan view in FIG. 17B. FIG. 17C provides a perspective view showing both the arrangement of opposing pair ridge sections 176*a*-176*d* on substrate 172, as well as the placement of the plurality of apertures 174 drilled or molded into section of connector 170.

Figure 18:
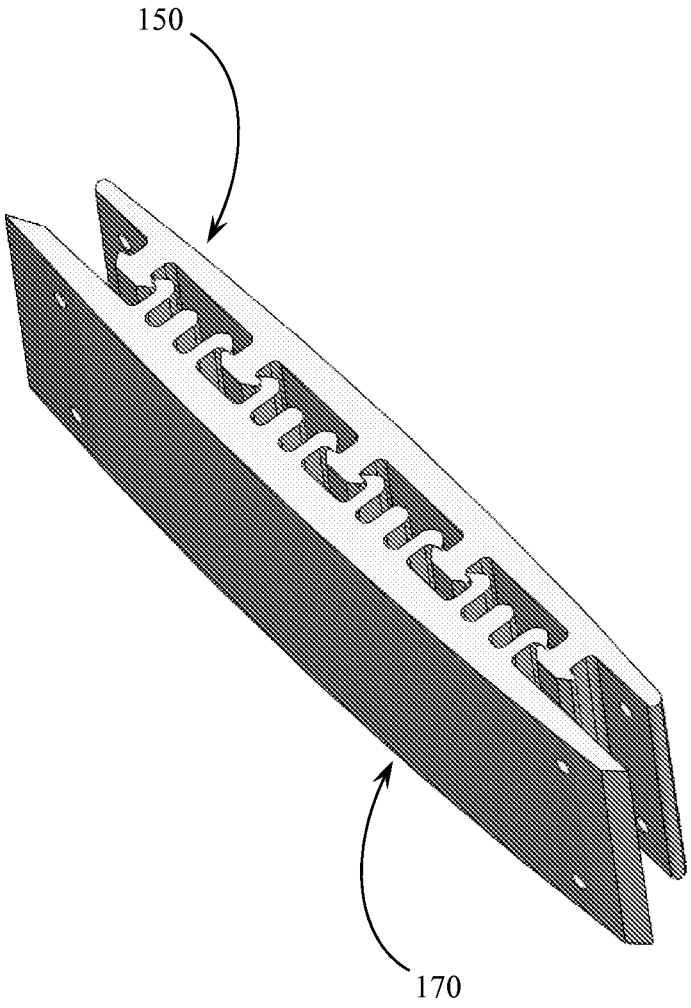
FIG. 18 is a perspective view of the connector top and bottom components shown in FIGS. 15C & 17C, showing the manner of attachment between the top and bottom components.

Reference is finally made to FIG. 18 for a perspective view of the connector bottom and top components 150 & 170 shown in FIGS. 15C & 17C, showing the manner of attachment between these components. In use, each of the components 150 & 170 would be secured to a strap or belt using the above described holes in each component section. In the view of FIG. 18, the angled end edges of component 170 are shown to facilitate the releasing action whereby the user may grip the angled edge with a fingertip to begin the motion of pulling the top component up and away from the bottom component.

Although the present invention has been described in conjunction with a number of preferred embodiments, those skilled in the art will recognize modifications to these embodiments that still fall within the scope of the present invention. Because of the wide variety of applications for the attachment surfaces of the present invention, the dimensions of the straps, bands, or patch surfaces may be structured as small or as large as required.

We claim:

1. Interlocking attachment surfaces, releasably connectable one to another in a face to face orientation, the attachment surfaces comprising:

a first attachment surface comprising a plurality of parallel spaced ridge pairs, each ridge pair comprising parallel first and second ridge walls having single, pointed, outward oriented ridge wall edges, and a turret ridge parallel to and positioned between the first and second ridge walls; and a second attachment surface comprising a plurality of parallel spaced post-based ridges, each post-based ridge comprising a ridge wall having a cap with two, pointed, outward oriented cap edges;

wherein two adjacent parallel spaced ridge pairs of the first attachment surface define a corresponding first longitudinal channel between the pairs, and the parallel first and second ridge walls of each parallel spaced ridge pair define a second longitudinal channel between the ridge walls, the longitudinal channels each having a depth, and wherein each turret ridge positioned between first and second ridge walls comprises a longitudinal blocking turret having a height approximately equal to or greater than the depth of the second longitudinal channel, and wherein a post-based ridge of the second attachment surface aligns with and intrudes into the corresponding first longitudinal channel but is prevented from intruding into the second longitudinal channel by the turret ridge therein.

2. The interlocking attachment surfaces of claim 1 wherein the first and second ridge walls of each ridge pair of the first attachment surface further comprise angled tops extending into the pointed, outward oriented ridge wall edges; and wherein the cap of each of the ridge walls of the post-based ridges of the second attachment surface further comprise angled tops extending into the pointed, outward oriented cap edges; whereby when the post-based ridges of the second attachment surface align with and between the parallel spaced ridge pairs of the first attachment surface, the angled tops of one engage the angled tops of the other and facilitate the insertion of the post-based ridges between the parallel spaced ridge pairs.

3. The interlocking attachment surfaces of claim 1 wherein the first attachment surface further comprises first and second surface edges oriented orthogonal to the plurality of parallel spaced ridge pairs, the first surface edge comprising an alignment bar extending from the attachment surface;

and wherein the second attachment surface further comprises first and second surface edges oriented orthogonal to the plurality of parallel spaced post-based ridge; whereby when the post-based ridges of the second attachment surface align with and between the parallel spaced ridge pairs of the first attachment surface, the alignment bar of the first attachment surface aligns with and receives the second edge of the second attachment surface.

4. The interlocking attachment surfaces of claim 1 wherein the first attachment surface further comprises first and second surface edges oriented orthogonal to the plurality of parallel spaced ridge pairs; and wherein the second attachment surface further comprises first and second surface edges oriented orthogonal to the plurality of parallel spaced post-based ridge, the first surface edge comprising an alignment bar extending from the attachment surface; whereby when the post-based ridges of the second attachment surface align with and between the parallel spaced ridge pairs of the first attachment surface, the alignment bar of the second attachment surface aligns with and receives the second edge of the first attachment surface.

5. The interlocking attachment surfaces of claim 1 wherein the first attachment surface further comprises first and second surface edges oriented orthogonal to the plurality of parallel spaced ridge pairs, the first surface edge comprising an alignment bar extending from the attachment surface; and wherein the second attachment surface further comprises first and second surface edges oriented orthogonal to the plurality of parallel spaced post-based ridge, the first surface edge comprising an alignment bar extending from the attachment surface; whereby when the post-based ridges of the second attachment surface align with and between the parallel spaced ridge pairs of the first attachment surface, the alignment bar of the first attachment surface aligns with and receives the second edge of the second attachment surface and the alignment bar of the second attachment surface aligns with and receives the second edge of the first attachment surface.

6. The interlocking attachment surfaces of claim 1 wherein at least one of the first and second attachment surfaces further comprise at least one attachment slot, the at least one attachment slot oriented parallel with the plurality of parallel spaced ridge pairs and the plurality of parallel spaced post-based ridges, the at least one attachment slot for receiving and retaining at least one of the first and second attachment surfaces on a strap.

7. The interlocking attachment surfaces of claim 6 wherein at least one attachment slot comprises two attachment slots, whereby the at least one of the first and second attachment surfaces received and retained on the strap is adjustably positionable along a length of the strap.

8. The interlocking attachment surfaces of claim 6 wherein the first and second attachment surfaces each comprise at least one attachment slot, the at least one attachment slot on each attachment surface oriented parallel with the plurality of parallel spaced ridge pairs and the plurality of parallel spaced post-based ridges, the at least one attachment slot on each attachment surface for receiving and retaining the respective attachment surface respectively on a strap.

9. The interlocking attachment surfaces of claim 8 wherein at least one attachment slot comprises two attachment slots, whereby each of the first and second attachment surfaces are received and retained on a strap and is adjustably positionable along a length of the strap.

* * * * *

UNITED STATES PATENT AND TRADEMARK OFFICE

CERTIFICATE OF CORRECTION

PATENT NO. : 9,198,483 B2
APPLICATION NO. : 14/217057
DATED : December 1, 2015
INVENTOR(S) : Thomas M. Adams and James D. Benner, Jr.

It is certified that error appears in the above-identified patent and that said Letters Patent is hereby corrected as shown below:

In the specification

Column 1, line 31, 'fowls' should be changed to --fouls--.

Column 1, line 42, 'fowled' should be changed to --fouled--.

Signed and Sealed this
Twelfth Day of April, 2016

Michelle K. Lee

Michelle K. Lee
*Director of the United States Patent and Trademark Office*